US008516699B2

(12) United States Patent
Grippe et al.

(10) Patent No.: US 8,516,699 B2
(45) Date of Patent: Aug. 27, 2013

(54) METHOD OF MANUFACTURING A HEAT EXCHANGER HAVING A CONTOURED INSERT

(75) Inventors: Frank M. Grippe, Kansasville, WI (US); Rifaquat Cheema, Kenosha, WI (US); David E. Janke, Racine, WI (US); Robert Barfknecht, Waterford, WI (US)

(73) Assignee: Modine Manufacturing Company, Racine, WI (US)

( * ) Notice: Subject to any disclaimer, the term of this patent is extended or adjusted under 35 U.S.C. 154(b) by 0 days.

(21) Appl. No.: 13/302,846

(22) Filed: Nov. 22, 2011

(65) Prior Publication Data

US 2012/0066905 A1 Mar. 22, 2012

Related U.S. Application Data

(63) Continuation of application No. 12/061,191, filed on Apr. 2, 2008, now abandoned.

(51) Int. Cl.
*B21D 53/02* (2006.01)

(52) U.S. Cl.
USPC ..... 29/890.03

(58) Field of Classification Search
USPC ..... 29/890.03
See application file for complete search history.

(56) References Cited

U.S. PATENT DOCUMENTS

| | | | |
|---|---|---|---|
| 1,553,093 | A | 9/1925 | Modine |
| 2,178,095 | A | 10/1939 | Bowser |
| 2,252,211 | A | 8/1941 | Seemiller |
| 2,329,789 | A | 9/1943 | Schank et al. |
| 2,615,687 | A | 10/1952 | Simmons |
| 2,735,698 | A | 2/1956 | Brinen |
| 2,782,009 | A | 2/1957 | Rippingille |
| 2,819,731 | A | 1/1958 | Louthan |
| 3,262,495 | A | 7/1966 | Baird |

(Continued)

FOREIGN PATENT DOCUMENTS

| | | |
|---|---|---|
| CH | 318033 | 12/1956 |
| DE | 2903543 | 8/1980 |

(Continued)

OTHER PUBLICATIONS

First Office Action from the State Intellectuall Property Office of China for Application No. 200910133633.9 dated Nov. 21, 2011, 5 pages.

(Continued)

*Primary Examiner* — David Bryant
*Assistant Examiner* — Moshe Wilensky
(74) *Attorney, Agent, or Firm* — Michael Best & Friedrich LLP

(57) ABSTRACT

A heat exchanger for transferring heat between a first working fluid and a second working fluid, including a pair of spaced apart headers, a number of tubes extending between the pair of headers and providing a flow path for the first working fluid and being positioned along a flow path for the second working fluid, and an insert supportable in one of the tubes and having a fold extending in a direction substantially parallel to the flow path for the first working fluid through the tubes. The fold can define first and second legs of the insert. A dimple can be formed on the first leg and a protrusion can be formed on the second leg opposite to the dimple on the first leg.

24 Claims, 10 Drawing Sheets

(56) References Cited

U.S. PATENT DOCUMENTS

| | | | | |
|---|---|---|---|---|
| 3,313,343 | A | 4/1967 | Ware et al. | |
| 3,372,743 | A | 3/1968 | Pall et al. | |
| 4,096,616 | A | 6/1978 | Coffinberry | |
| 4,303,052 | A | 12/1981 | Manfredo et al. | |
| 4,420,039 | A | 12/1983 | Dubrovsky | |
| 4,428,418 | A | 1/1984 | Beasley et al. | |
| 4,436,145 | A | 3/1984 | Manfredo et al. | |
| 4,474,162 | A | 10/1984 | Mason | |
| 4,733,722 | A | 3/1988 | Forbes et al. | |
| 4,823,868 | A | 4/1989 | Neebel | |
| 4,903,762 | A | 2/1990 | Marsais et al. | |
| 5,029,636 | A | 7/1991 | Kadle | |
| 5,307,870 | A | 5/1994 | Kamiya et al. | |
| 5,372,187 | A | 12/1994 | Haushalter | |
| 5,417,280 | A | 5/1995 | Hayashi et al. | |
| 5,560,424 | A | 10/1996 | Ogawa | |
| 5,623,989 | A | 4/1997 | Kroger | |
| 5,625,229 | A | 4/1997 | Kojima et al. | |
| 5,636,685 | A | 6/1997 | Gawve et al. | |
| 5,671,806 | A | 9/1997 | Schmalzried | |
| 5,685,075 | A | 11/1997 | Kato | |
| 5,845,701 | A | 12/1998 | Ruppel et al. | |
| 5,996,633 | A | 12/1999 | Kato | |
| 6,019,169 | A | 2/2000 | Ruppel et al. | |
| 6,164,370 | A | 12/2000 | Robinson et al. | |
| 6,179,050 | B1 | 1/2001 | Dey et al. | |
| 6,293,337 | B1 | 9/2001 | Strahle et al. | |
| 6,435,268 | B1 | 8/2002 | Bhatti et al. | |
| 6,474,408 | B1 | 11/2002 | Yeh et al. | |
| 6,729,388 | B2 | 5/2004 | Emrich et al. | |
| 6,904,965 | B2 | 6/2005 | Beck et al. | |
| 6,920,918 | B2 | 7/2005 | Knecht et al. | |
| 6,964,296 | B2 | 11/2005 | Memory et al. | |
| 7,032,313 | B2 | 4/2006 | Memory et al. | |
| 7,040,386 | B2 | 5/2006 | Shimoya et al. | |
| 7,077,190 | B2 | 7/2006 | Hayashi et al. | |
| 7,107,680 | B2 | 9/2006 | Ueda | |
| 7,174,948 | B2 | 2/2007 | Schindler et al. | |
| 7,204,302 | B2 | 4/2007 | Shibagaki et al. | |
| 7,255,159 | B2 | 8/2007 | Sagasser et al. | |
| 7,290,595 | B2 | 11/2007 | Morishita et al. | |
| 7,367,386 | B2 | 5/2008 | Sato et al. | |
| 7,487,589 | B2 | 2/2009 | Smith et al. | |
| 7,866,042 | B2 * | 1/2011 | Kolb | 29/890.03 |
| 8,016,025 | B2 | 9/2011 | Brost et al. | |
| 8,151,617 | B2 | 4/2012 | Feng et al. | |
| 8,261,816 | B2 | 9/2012 | Ambros et al. | |
| 2002/0007935 | A1 | 1/2002 | Marsala | |
| 2003/0010480 | A1 | 1/2003 | Shibagaki et al. | |
| 2004/0177668 | A1 | 9/2004 | Sagasser et al. | |
| 2005/0081379 | A1 * | 4/2005 | Askani et al. | 29/890.053 |
| 2005/0161206 | A1 | 7/2005 | Ambros et al. | |
| 2005/0224070 | A1 | 10/2005 | Hanai et al. | |
| 2006/0201663 | A1 | 9/2006 | Strahle et al. | |
| 2006/0231240 | A1 | 10/2006 | Rothenhofer et al. | |
| 2006/0283585 | A1 | 12/2006 | Smith et al. | |
| 2007/0012430 | A1 | 1/2007 | Duke et al. | |
| 2007/0056721 | A1 | 3/2007 | Usui et al. | |
| 2007/0114007 | A1 | 5/2007 | Schindler et al. | |
| 2007/0175617 | A1 | 8/2007 | Brost et al. | |
| 2007/0227715 | A1 | 10/2007 | Shimoya et al. | |
| 2008/0041556 | A1 | 2/2008 | Braun et al. | |
| 2008/0047696 | A1 | 2/2008 | Sperandei et al. | |
| 2009/0025916 | A1 | 1/2009 | Meshenky et al. | |
| 2009/0194265 | A1 | 8/2009 | Nakamura | |
| 2010/0025024 | A1 | 2/2010 | Meshenky et al. | |

FOREIGN PATENT DOCUMENTS

| | | |
|---|---|---|
| DE | 3743293 | 6/1989 |
| DE | 3815070 | 11/1989 |
| DE | 4223423 | 1/1994 |
| DE | 4307053 | 9/1994 |
| DE | 4313505 | 10/1994 |
| DE | 19519633 | 12/1996 |
| DE | 69315281 | 3/1998 |
| DE | 19644584 | 4/1998 |
| DE | 19651625 | 6/1998 |
| DE | 19853455 | 6/1999 |
| DE | 19836889 | 2/2000 |
| DE | 20003919 | 5/2000 |
| DE | 19902004 | 7/2000 |
| DE | 10040645 | 6/2002 |
| DE | 10238882 | 5/2003 |
| DE | 10242311 | 3/2004 |
| DE | 10359806 | 7/2005 |
| DE | 202004020294 | 5/2006 |
| DE | 102005034997 | 2/2007 |
| EP | 242063 | 10/1987 |
| EP | 584806 | 3/1994 |
| EP | 704667 | 3/1996 |
| EP | 974804 | 1/2000 |
| EP | 1376043 | 1/2004 |
| EP | 1411315 | 4/2004 |
| EP | 1464908 | 10/2004 |
| EP | 1522811 | 4/2005 |
| EP | 1544564 | 6/2005 |
| FR | 2447529 | 8/1980 |
| FR | 2777645 | 10/1999 |
| GB | 1129924 | 10/1968 |
| JP | 1305296 | 12/1989 |
| JP | 4198692 | 7/1992 |
| JP | 4332392 | 11/1992 |
| JP | 8025028 | 1/1996 |
| JP | 2000097589 | 4/2000 |
| JP | 2000121286 | 4/2000 |
| JP | 2000304486 | 11/2000 |
| JP | 2003106785 | 4/2003 |
| JP | 2003240387 | 8/2003 |
| JP | 2007003029 | 1/2007 |
| JP | 2007225190 | 9/2007 |
| RU | 2047081 | 10/1995 |
| WO | WO 2004085947 | 10/2004 |
| WO | WO 2005001366 | 1/2005 |
| WO | WO 2006010463 | 2/2006 |

OTHER PUBLICATIONS

Office Action Non-Final Rejection for U.S. Appl. No. 11/015,159 dated Nov. 9, 2007 (10 pages).

PCT/US2008/051747 International Search Report dated Jun. 5, 2008, 2 pages.

Office Action Final Rejection for U.S. Appl. No. 11/015,159 dated Jun. 11, 2008 (11 pages).

Office Action Request for Restriction/Election for U.S. Appl. No. 11/015,159 dated Jan. 7, 2009(5 pages).

Office Action Non-Final Rejection for U.S. Appl. No. 11/015,159 dated May 6, 2009 (8 pages).

PCT/US2008/051747 International Preliminary Report on Patentability dated Aug. 6, 2009 (6 pages).

DE102009015849.9 German Search Report dated Sep. 22, 2009, 4 pages.

Office Action Final Rejection for U.S. Appl. No. 11/015,159 dated Nov. 24, 2009 (6 pages).

Office Action from United States Patent office for U.S. Appl. No. 11/594,454 dated Feb. 3, 2010 (8 pages).

Office Action Non-Final Rejection for U.S. Appl. No. 11/015,159 dated Apr. 13, 2010 (6 pages).

Office Action Examiner Interview Summary for U.S. Appl. No. 11/015,159 dated Jun. 17, 2010 (4 pages).

First Office Action from the State Intellecutal Property Office of the People's Republic of China for Application No. 200880002935.6 dated Jul. 15, 2010 (3 pages—English Translation).

Office Action Final Rejection for U.S. Appl. No. 11/015,159 dated Dec. 3, 2010 (6 pages).

Chinese Office Action for Application No. 200880002935.6 dated Jan. 26, 2011 (3 pages).

Office Action from United States Patent office for U.S. Appl. No. 12/061,191 dated Aug. 22, 2011 (9 pages).

* cited by examiner

METHOD OF MANUFACTURING A HEAT EXCHANGER HAVING A CONTOURED INSERT

CROSS-REFERENCE TO RELATED APPLICATIONS

This application is a continuation of U.S. patent application Ser. No. 12/061,191, filed Apr. 2, 2008. The entire contents of which are hereby incorporated by reference herein.

FIELD OF THE INVENTION

The present invention relates to heat exchangers and more particularly, to an exhaust gas recirculation cooler and a method of assembling the same.

SUMMARY

In some embodiments, the present invention provides a heat exchanger for transferring heat between a first working fluid and a second working fluid. The heat exchanger can include a pair of spaced apart headers, a number of tubes extending between the pair of headers and providing a flow path for the first working fluid and being positioned along a flow path for the second working fluid, and an insert supportable in one of the tubes and having a fold extending in a direction substantially parallel to a length of the one of the tubes between the pair of headers. The insert can include a number of dimples extending into and spaced along the fold.

The present invention also provides a heat exchanger for transferring heat between a first working fluid and a second working fluid including a pair of spaced apart headers, a number of tubes extending between the pair of headers and providing a flow path for the first working fluid and being positioned along a flow path for the second working fluid, and an insert supportable in one of the tubes and having a fold extending in a direction substantially parallel to the flow path for the first working fluid through the tubes. The fold can define first and second legs of the insert. A dimple can be formed on the first leg and a protrusion can be formed on the second leg opposite to the dimple on the first leg.

In some embodiments, the present invention provides a heat exchanger for transferring heat between a first working fluid and a second working fluid including a pair of spaced apart headers, a number of tubes extending between the pair of headers and providing a flow path for the first working fluid and being positioned along a flow path for the second working fluid, and an insert supportable in one of the tubes and having a serpentine fold extending in a direction substantially parallel to a length of the tube between the pair of headers.

Other aspects of the invention will become apparent by consideration of the detailed description and accompanying drawings.

DETAILED DESCRIPTION

Figure 1:
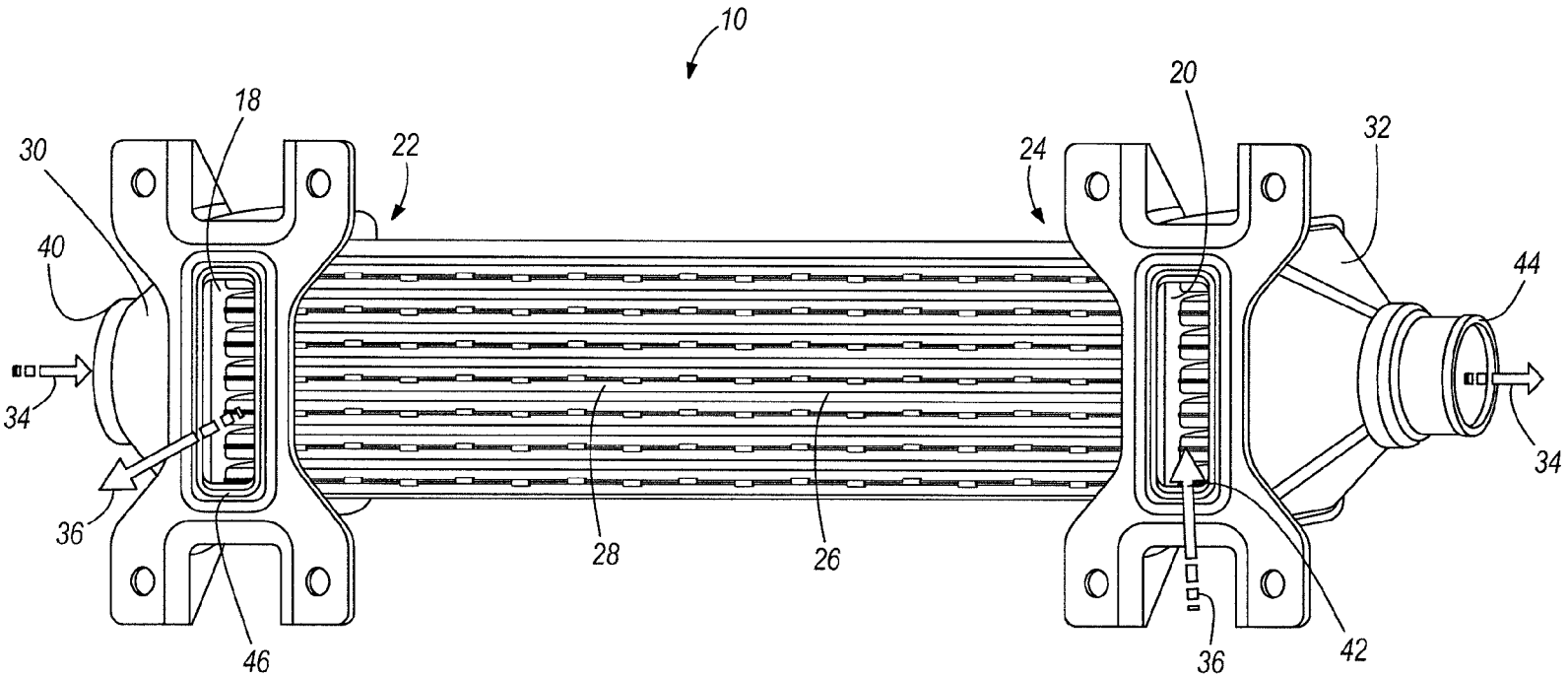
FIG. 1 is a bottom perspective view of a heat exchanger according to some embodiments of the present invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Also, it is to be understood that phraseology and terminology used herein with reference to device or element orientation (such as, for example, terms like "central," "upper," "lower," "front," "rear," and the like) are only used to simplify description of the present invention, and do not alone indicate or imply that the device or element referred to must have a particular orientation. In addition, terms such as "first" and "second" are used herein for purposes of description and are not intended to indicate or imply relative importance or significance.

FIGS. 1-4 illustrate a heat exchanger 10 according to some embodiments of the present invention. In some embodiments, including the illustrated embodiments of FIGS. 1-4, the heat exchanger 10 can operate as an exhaust gas recirculation cooler (EGRC) and can be operated with the exhaust system of a vehicle. In other embodiments, the heat exchanger 10 can be used in other (e.g., non-vehicular) applications, such as, for example, in electronics cooling, industrial equipment, building heating and air-conditioning, and the like. In addition, it should be appreciated that the heat exchanger 10 of the present invention can take many forms, utilize a wide range of materials, and can be incorporated into various other systems.

During operation and as explained in greater detail below, the heat exchanger 10 can transfer heat from a high temperature first working fluid (e.g., exhaust gas, water, engine coolant, $CO_2$, an organic refrigerant, R12, R245fa, air, and the like) to a lower temperature second working fluid (e.g., water, engine coolant, $CO_2$, an organic refrigerant, R12, R245fa, air, and the like). In addition, while reference is made herein to transferring heat between two working fluids, in some embodiments of the present invention, the heat exchanger 10 can operate to transfer heat between three or more fluids. Alternatively or in addition, the heat exchanger 10 can operate as a recuperator and can transfer heat from a high temperature location of a heating circuit to a low temperature location of the same heating circuit. In some such embodiments, the heat exchanger 10 can transfer heat from a working fluid traveling through a first portion of the heat transfer circuit to the same working fluid traveling through a second portion of the heat transfer circuit.

Figure 2:
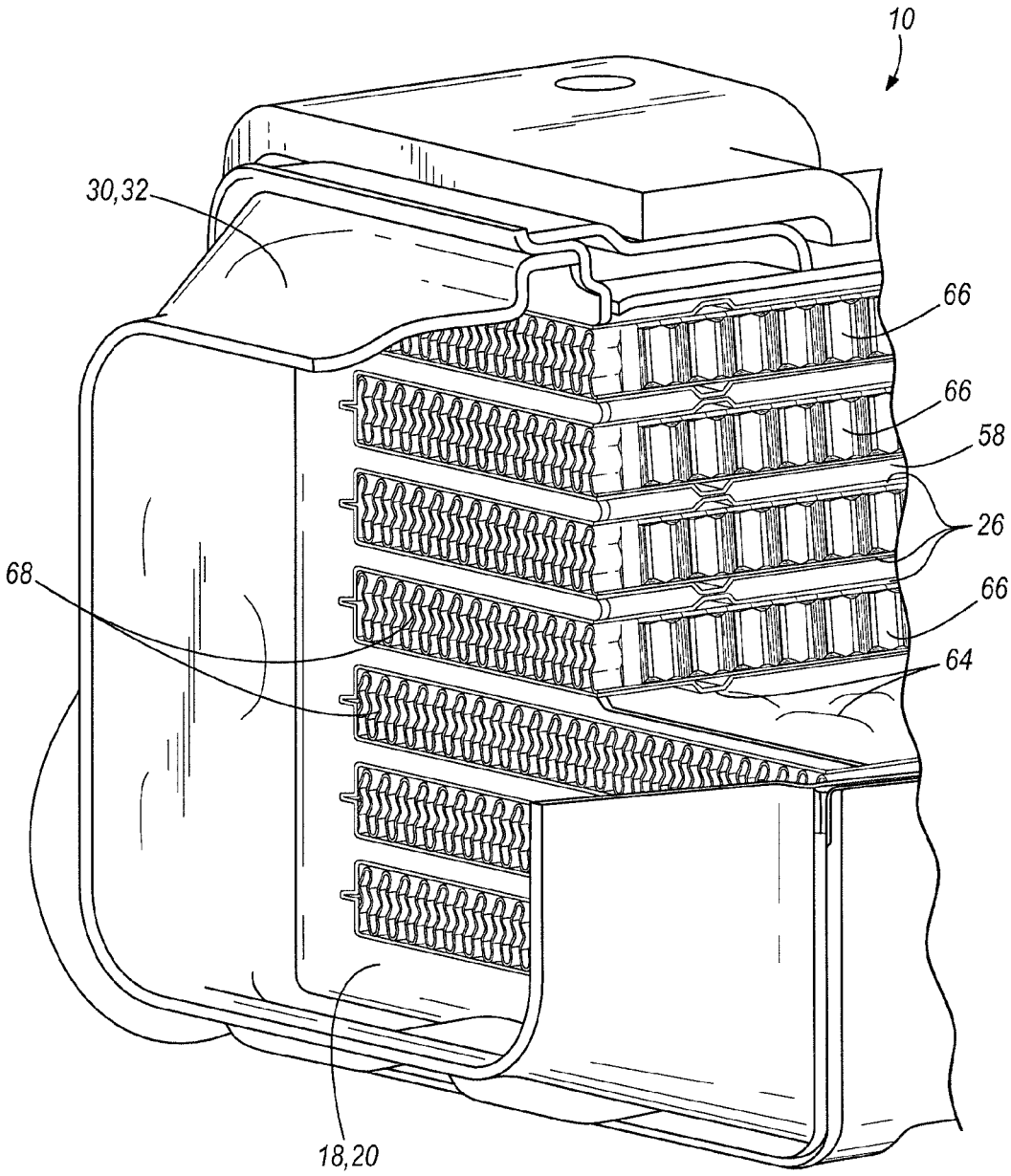
FIG. 2 is a partially cut-away view of a portion of the heat exchanger shown in FIG. 1.
Figure 3:
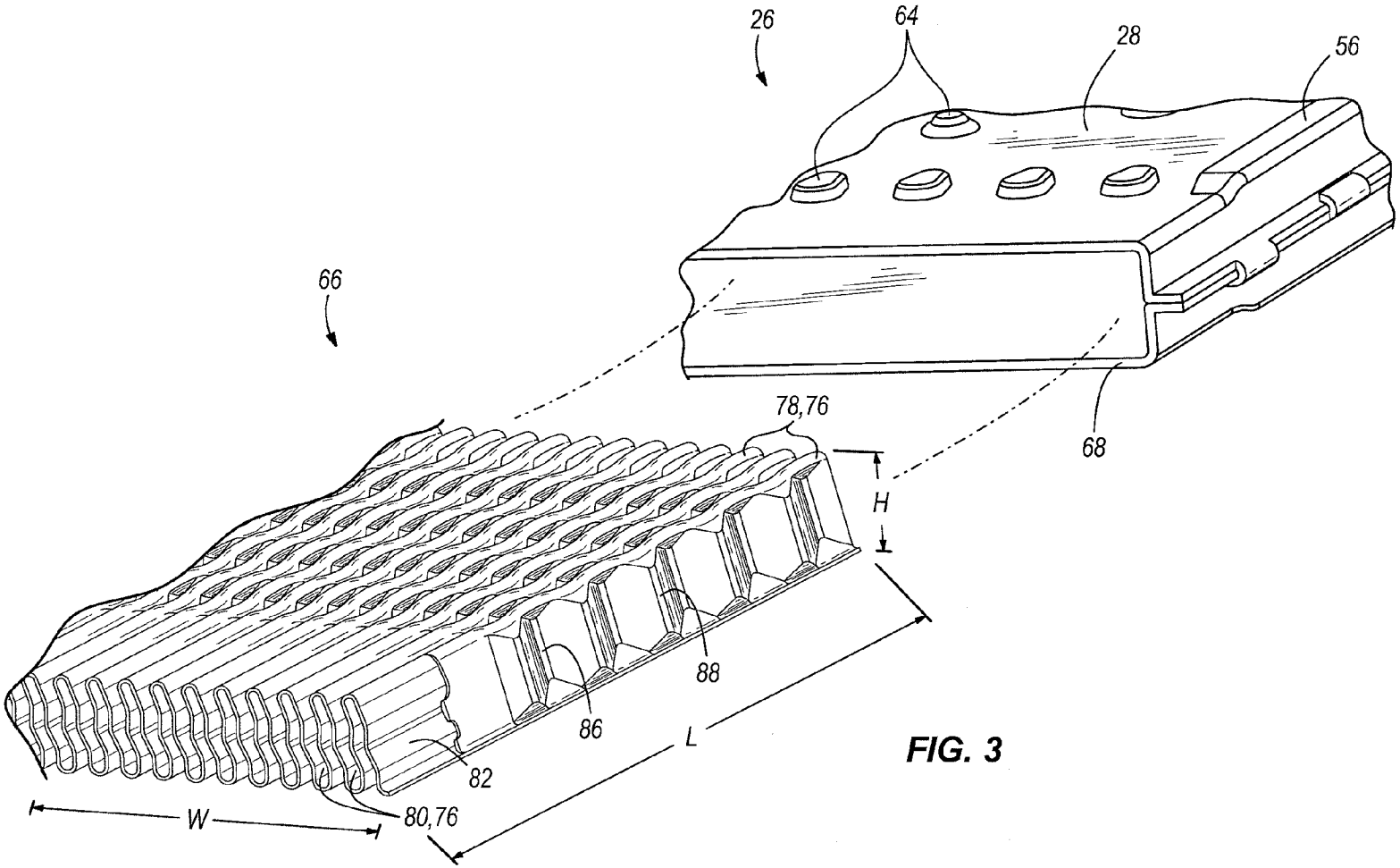
FIG. 3 is an exploded perspective view of a portion of a tube and an insert of the heat exchanger shown in FIG. 1.
Figure 4:
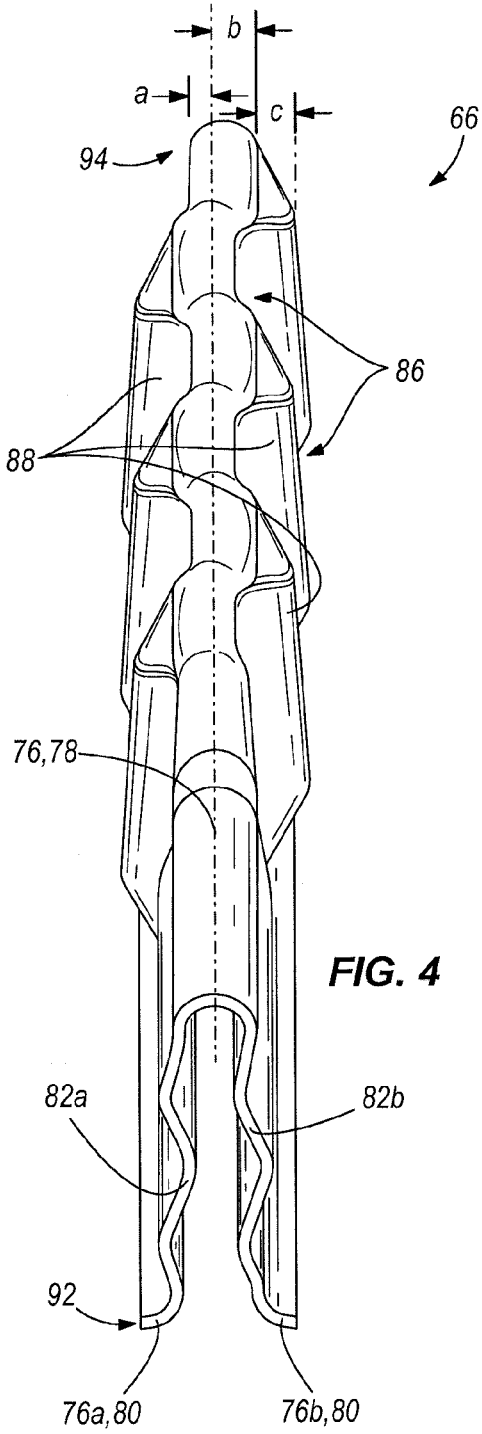
FIG. 4 is a perspective view of a portion of the insert shown in FIG. 3.
Figure 5:
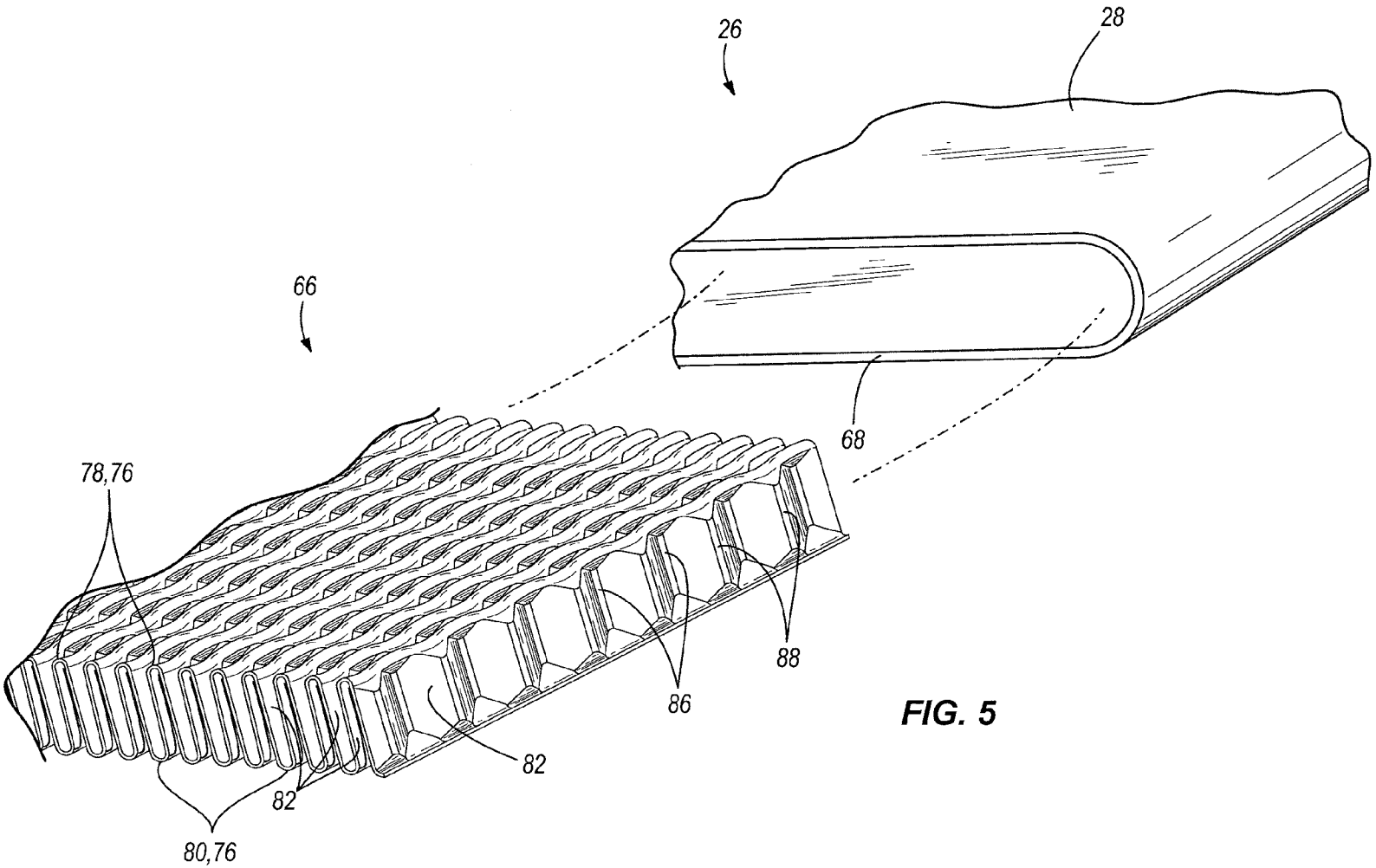
FIG. 5 is an exploded perspective view of a portion of a tube and an insert according to an alternate embodiment of the present invention.

As shown in FIGS. 1 and 2, the heat exchanger 10 can include a first header 18 and a second header 20 positioned at respective first and second ends 22, 24 of a stack of heat exchanger tubes 26 having outer surfaces 28 (shown in FIGS. 1, 3, and 5). In the illustrated embodiment of FIGS. 1-4, the first end 22 is secured to a first collecting tank 30 and the second end 24 is secured to a second collecting tank 32. In other embodiments, the heat exchanger 10 can include a single header 18 and/or a single tank 30 located at one of the first and second ends 22, 24 or at another location on the heat exchanger 10.

As shown in FIGS. 1 and 2, each of the tubes 26 can be secured to the first and second headers 18, 20 such that a first working fluid flowing through the heat exchanger 10 is maintained separate from a second working fluid flowing through the heat exchanger 10. More specifically, the heat exchanger 10 defines a first flow path (represented by arrows 34 in FIG. 1) for the first working fluid and a second flow path (represented by arrows 36 in FIG. 1) for a second working fluid, and the first and second flow paths 34, 36 are separated such that the first working fluid is prevented from entering the second flow path 36 and such that the second working fluid is prevented from entering the first flow path 34.

In some embodiments, such as the illustrated embodiment, the tubes 26 are secured to the first and second headers 18, 20 and the first and second tanks 30, 32 such that the first working fluid enters the heat exchanger 10 through a first inlet aperture 40 in the first tank 30, travels through the tubes 26 of the heat exchanger 10 along the first flow path 34, and is prevented from entering the second flow path 36. In these embodiments, the tubes 26 can be secured to the first and second headers 18, 20 and the first and second tanks 30, 32 such that the second working fluid enters the heat exchanger 10 through a second inlet aperture 42 in the second tank 32, travels through the heat exchanger 10 along the second flow path 36 between the tubes 26, and is prevented from entering the first flow path 34.

In other embodiments, the tubes 26 can have other orientations and configurations and the first and second flow paths 34, 36 can be maintained separate by dividers, inserts, partitions, and the like. In still other embodiments, the first flow path 34 can extend through some of the tubes 26 while the second flow path 36 can extend through other tubes 26.

As shown in FIG. 2, the headers 18, 20 can have apertures sized to receive one or more of the tubes 26. As illustrated by FIGS. 1 and 2, the first working fluid flowing along the first flow path 34 can enter the tubes 26 through apertures formed in the first header 18. In these embodiments, the first header 18 can also direct the second working fluid from the second inlet aperture 42 between adjacent tubes 26 and can prevent the second working fluid from flowing into the tubes 26. The first header 18 can also prevent the first working fluid from flowing between the tubes 26.

In the illustrated embodiment, the heat exchanger 10 is configured as a cross-flow heat exchanger such that the first flow path 34 or a portion of the first flow path 34 is opposite to the second flow path 36 or a portion of the second flow path 36. In other embodiments, the heat exchanger 10 can have other configurations and arrangements, such as, for example, a parallel-flow or a counter-flow configuration.

In the illustrated embodiment, the heat exchanger 10 is configured as a single-pass heat exchanger with the first working fluid traveling along the first flow path 34 through at least one of a number of tubes 26 and with the second working fluid traveling along the second flow path 36 between adjacent tubes 26. In other embodiments, the heat exchanger 10 can be configured as a multi-pass heat exchanger with the first working fluid traveling in a first pass through one or more of the tubes 26 and then traveling in a second pass through one or more different tubes 26 in a direction opposite to the flow direction of the first working fluid in the first pass. In these embodiments, the second working fluid can travel along the second flow path 36 between adjacent tubes 26.

In yet other embodiments, the heat exchanger 10 can be configured as a multi-pass heat exchanger with the second working fluid traveling in a first pass between a first pair of adjacent tubes 26 and then traveling in a second pass between another pair of adjacent tubes 26 in a direction opposite to the flow direction of the second working fluid in the first pass. In these embodiments, the first working fluid can travel along the first flow path 34 through at least one of the tubes 26.

In the illustrated embodiment, the heat exchanger 10 includes seven tubes 26, each of which has a substantially rectangular cross-sectional shape. In other embodiments, the heat exchanger 10 can include one, two, three, four, five, six, eight, or more tubes 26, each of which can have a triangular, circular, square or other polygonal, oval, or irregular cross-sectional shape.

As mentioned above, in some embodiments, the second flow path 36 or a portion of the second flow path 36 can extend across the outer surface 28 of one or more of the tubes 26. In some such embodiments, ribs 56 (see FIG. 3) can be formed along the outer surfaces 28 of the tubes 26 to at least partially define channels 58 between adjacent tubes 26. Alternatively, as shown in FIG. 5, the tubes 26 of the heat exchanger 10 can be generally oval shaped (i.e., a simple extruded tube) and devoid of ribs 56 defining channels 58. A housing can be provided around the tubes 26 to prevent the second fluid from leaking out of the heat exchanger 10 between adjacent tubes 26. In such an embodiment, the housing would define the second flow path 36 between/around the tubes 26.

In embodiments, such as the illustrated embodiment of FIGS. 1-4, having outwardly extending ribs 56, the ribs 56 of each tube 26 can be secured to an adjacent tube 26. In some such embodiments, the ribs 56 of one tube 26 can be soldered, brazed, or welded to an adjacent tube 26. In other embodiments, adjacent tubes 26 can be secured together with interengaging fasteners, other conventional fasteners, adhesive or cohesive bonding material, by an interference fit, etc. In addition, a housing can be provided around the tubes 26 of the embodiment illustrated in FIGS. 1-4.

Additional elevations, recesses, or deformations 64 can also or alternatively be provided on the outer surfaces 28 of the tubes 26 to provide structural support to the heat exchanger 10, prevent the deformation or crushing of one or more tubes 26, maintain a desired spacing between adjacent tubes 26, improve heat exchange between the first and second working fluids, and/or generate turbulence along one or both of the first and second flow paths 34, 36.

The heat exchanger 10 can include inserts 66, which improve heat transfer between the first and second working fluids as the first and second working fluids travel along the first and second flow paths 34, 36, respectively. The inserts 66 can provide the heat exchanger core (i.e., the tubes 26) with increased surface area for distribution of the heat provided by the first and/or second working fluids. As shown in FIGS. 2, 3, and 5, the inserts 66 can be positioned in the tubes 26. Alternatively or in addition, inserts 66 can be positioned between adjacent tubes 26. In other embodiments, inserts 66 can be integrally formed with the tubes 26 and can extend outwardly from the outer surfaces 28 of the tubes 26, or alternatively, inwardly from inner surfaces of the tubes 26. In some embodiments, the inserts 66 can improve the durability and strength of the heat exchanger 10. The configurations (geometrical and topographical) of the inserts 66 can be such that the expansion and contraction experienced by the material due to thermal fluctuations can be compensated for with increased flexibility (discussed in further detail below).

In the illustrated embodiment of FIG. 2, an insert 66 is supported in each of the tubes 26, and extends along the entire length or substantially the entire length of each of the tubes 26 between opposite ends 68 of the tubes 26. As FIG. 2 illustrates, the insert 66 can also or alternatively extend across the entire width or substantially the entire width of each of the tubes 26 between opposite sides of the tubes 26. In other embodiments, an insert 26 can be supported in only one or less than all of the tubes 26, and the insert(s) 66 can extend substantially the entire length of the tube(s) 26 between opposite ends 68 of the tube(s) 26, or alternatively, the insert 66 can extend through the tube(s) 26 along substantially less than the entire length of the tube(s) 26. In still other embodiments, two or more inserts 66 can be supported by or in each tube 26. In some embodiments, the inserts 66 can be secured to the tubes 26. In some such embodiments, the inserts 66 are soldered, brazed, or welded to the tubes 26. In other embodiments, the inserts 26 can be connected to the tubes 26 in another manner, such as, for example, by an interference fit, adhesive or cohesive bonding material, fasteners, etc.

In some embodiments, the ends 68 of the tubes 26 can be press-fit into one or both of the first and second headers 18, 20. In some such embodiments, the ends 68 of the tubes 26 and the inserts 66 supported in the tubes 26 or between the tubes 26 can be at least partially deformed when the tubes 26 and/or the inserts 66 are press-fit into the first and/or second headers 18, 20. As such, the tubes 26 and/or the inserts 66 are pinched and maintained in compression to secure the tubes 26 and/or the inserts 66 in a desired orientation and to prevent leaking In some embodiments, the tubes 26 can be brazed, soldered, or welded to the first and/or second headers 18, 20.

In the illustrated embodiments, roll-formed sheets of metal are folded to form the inserts 66 in a method that will be described in further detail below. In other embodiments, the inserts 66 can be cast or molded in a desired shape and can be formed from other materials (e.g., aluminum, copper, iron, and other metals, composite material, alloys, and the like). In still other embodiments, the inserts 66 can be cut or machined to shape in any manner, can be extruded or pressed, can be manufactured in any combination of such operations, and the like.

Figure 7:
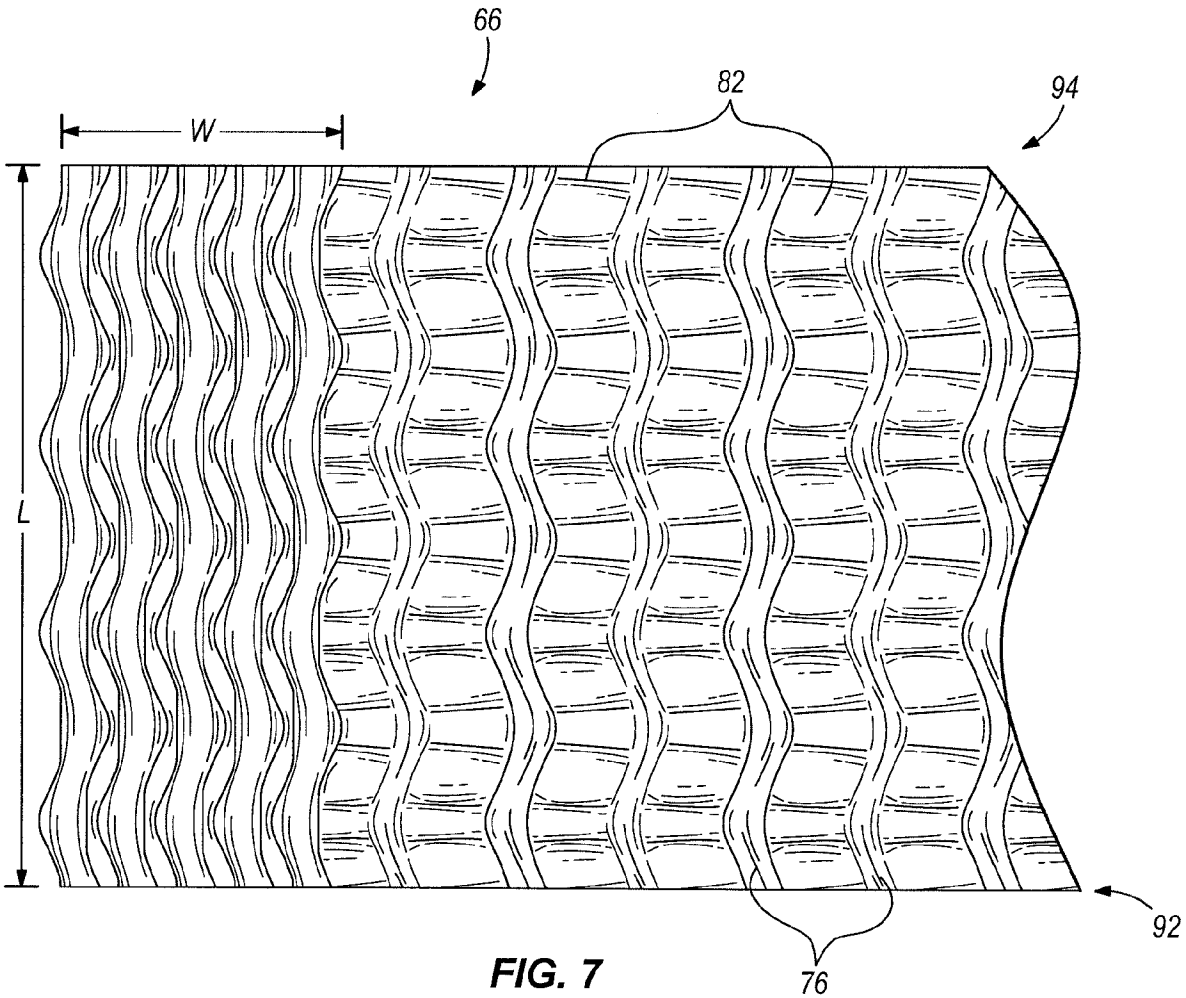
FIG. 7 is a top view of a partially formed insert that can be manufactured according to the method shown in FIG. 9.

As most clearly shown in FIGS. 3 and 7, the insert 66 can be corrugated and have an overall length L, width W, and height H. The length L of the insert 66 is defined as the general direction of fluid flow within the tube 26 (i.e., from the first header 18 to the second header 20). As shown in the embodiment illustrated in FIG. 3, each fold forms a serpentine spine 76 that extends generally in parallel to the length L of the insert 66.

The illustrated embodiment of the insert 66 includes a series of parallel-running spines 76 that form alternating peaks 78 and valleys 80 along the width W of the insert 66. As shown in FIG. 2, the peaks 78 and valleys 80 can engage respective upper and lower interior sides (e.g., between upper and lower sides in FIGS. 2, 3, and 5) of a tube 26. In the illustrated embodiment, legs or flanks 82 extend between each pair of adjacent folds (i.e., from a peak 78 to a valley 80 or vice versa) along the length L, to give the insert 66 a height H. In addition, the inserts 66 of some embodiments can have pointed, squared, or irregularly shaped peaks 78 and/or valleys 80. The resulting lateral edge of the insert 66 of the illustrated embodiment, as shown in FIGS. 2 and 3 can be generally wavy. However, in other embodiments, the lateral edge can be generally sinusoidal or saw-toothed, among other shapes. The structural elements formed by each fold 76 of the corrugated insert 66 are described more specifically with reference to FIGS. 4 and 6 below.

Figure 6:
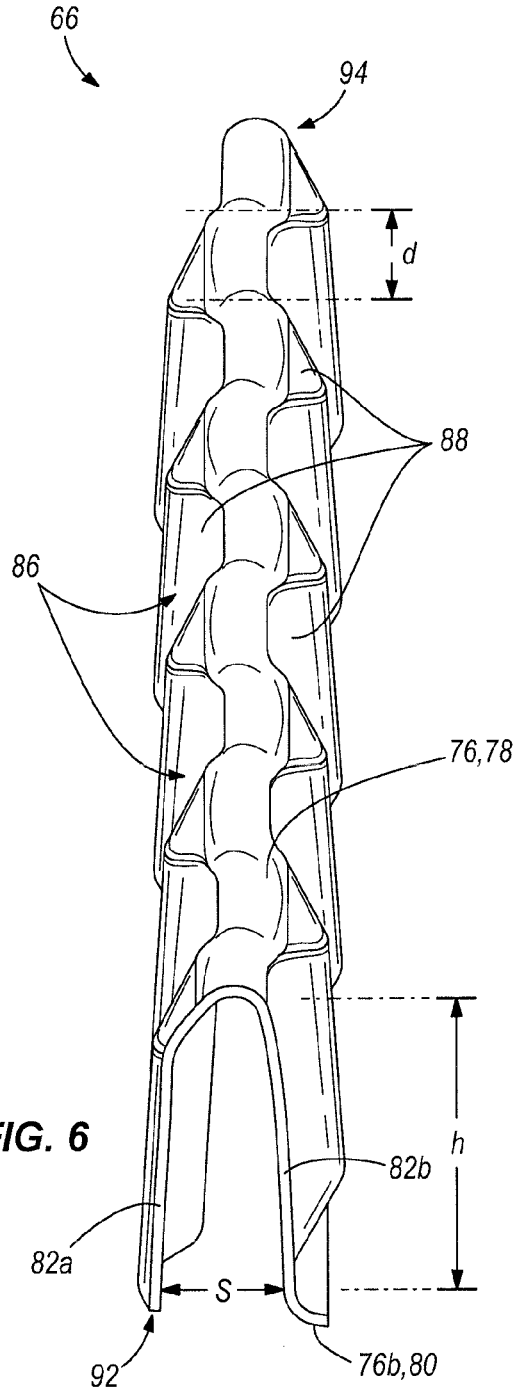
FIG. 6 is a perspective view of a portion of the insert shown in FIG. 5.

As illustrated by FIGS. 4 and 6, a first leg 82*a* can be at least partially defined on one side of a spine 76 and a second leg 82*b* can be at least partially defined on the other side of the spine 76. Fold 76*a* is positioned immediately adjacent to the first leg 82*a* and defines a height h of the leg 82*a*. Similarly, fold 76*b* is positioned at the distal end of the second leg 76*b*, which has the same height h. The space S between adjacent legs 82*a*, 82*b* is defined as the distance between the points located at the same distance along length L and height h of each leg 82. The legs 82 of the insert 66 can also have various topographical configurations. For example, at one point along the length L, the legs 82 can be contoured or wavy (i.e., when viewed from an end of the insert 66 as shown in FIGS. 3 and 4, and at another point along the length L, the legs 82 can be straight.

As shown in FIGS. 3-8, the legs 82 can include contour elements such as dimples 86 and protrusions 88 spaced along their length L. These elements are deformations in the material that forms the insert 66 and do not pierce or provide connections between opposite sides of the insert 66. In some such embodiments, a dimple 86 formed on one side of a leg 82 can consequently form a protrusion 88 on the opposite side of the leg 82 (i.e., a dimple 86 is a geometric complement of protrusion 88). The contour elements formed in the insert 66 can appear as pyramid, frustum, prism, and/or hemispheroid-like projections or dimples, among others. In the illustrated embodiment, the contour elements each have two planes of symmetry (one of which is the length L, space s plane, and the other of which is the height h, space s plane). As such, the upper half of the contour element is a mirror image of the bottom half (with respect to the height h of the leg 82 it is positioned on). Similarly, the left half of the contour element is a mirror image of the right half (with respect to the length L of the leg 82 it is positioned on). In some embodiments, a protrusion 86 in one leg 82 can be positioned such that it is at least partially receivable in a dimple 88 in an adjacent to leg 82 (i.e., at the same distance along height h and length L of each leg).

In some embodiments, contour elements can extend along the entire height h of the leg 82 from one fold 76 to an adjacent fold 76 (i.e., from a peak 78 to an adjacent valley 80 or vice versa). Each contour element has a width d, as shown in FIG. 6. In the illustrated embodiment, the width d also indicates the spacing between similar contour elements. In other embodiments, the spacing between similar contour elements can be greater than the width d of an intervening or alternating contour element.

As shown in FIG. 4, the serpentine shape of the spine 76 is determined by the geometry and placement of the dimples 86 and protrusions 88. In the illustrated embodiments, dimples 86 are alternated with protrusions 88 along the length L of each leg 82, and each of the contours extends between adjacent folds 76. Accordingly, a number of dimples 86 and a number of protrusions 88 can be spaced along the edge of each fold 76. FIG. 4 includes reference measurements to more clearly illustrate the geometry of the insert 66. Specifically, reference a indicates the distance between the midline of the fold 76 and the edge of a dimple 86, reference b indicates the distance between the midline of the fold 76 and the edge of a protrusion 88, and reference c indicates the lateral distance (i.e., the direction normal to the length L of the insert and width d of the contour element) from the edge of the contour element at the fold 76, to its outermost point/extension.

As illustrated in FIGS. 3-6, an insert 66 formed with longitudinal rows of alternating contour elements 86, 88, can be folded such that the space S between adjacent legs 82 at a particular height h can be generally constant along their length L. Thus, the flow path cross-sectional area is essentially constant along the length L between opposite ends 68 of the tube 26. Accordingly, the first flow path 34 is made circuitous and is consequently longer than a straighter flow path. Such an insert configuration can increase turbulence of the working fluid and consequently allow for more efficient heat transfer without causing significant pressure changes/buildup along the length L of the insert 66. Additionally, contour elements formed in the inserts 66 can impact the shape of the spine 76. For example, FIGS. 3-8 show how a pattern of dimples 86 and protrusions 88—specifically longitudinal rows of the continuously alternating contour elements—can create a serpentine-shaped spine 76. As such, even the flow path immediately adjacent to the inner surfaces of the tube 26 is elongated and made circuitous. The serpentine shape of the spine 76 can also provide a reinforced connection between the tube 26 and the insert 66 which can also improve heat transfer.

In embodiments having inserts 66 with wavy or contoured cross-sections, such as the illustrated embodiments, the inserts 66 operate as elastic members to absorb or at least partially absorb vibrations and/or to absorb expansions and contractions of the inserts 66 caused by fluctuating temperatures of the first and/or second working fluids. In some such embodiments, the elasticity of the contoured inserts 66 prevents or reduces cracking and breaking of the inserts 66. Alternatively or in addition, the elasticity of the contoured inserts 66 prevents and/or reduces cracking and breaking of connections (e.g., solder points, braze points, weld points, etc.) between the spines 76 of the inserts 66 and the interior sides of the tubes 26.

As shown in FIGS. 5-8, in some embodiments, contours 86, 88 can extend continuously from a first lateral edge 92 to a second lateral edge 94, along the length L of a leg 82. In other embodiments, such as those illustrated in FIGS. 2-4, contours only extend continuously along the length L of a middle portion of the insert 66, while the edges 92, 94 have a different topographical configuration, such as, for example, wavy. The contoured portion can allow for changes in length L (i.e., longitudinal flexibility), while the wavy edges can compensate for changes in height h of the legs 82 (i.e., vertical flexibility). This can be desirable in embodiments where the height of the insert H is constrained by connection to the inner surfaces of the tube 26, especially where the tube ends 68 are further constrained by the first and second headers 18, 20.

Figure 9:
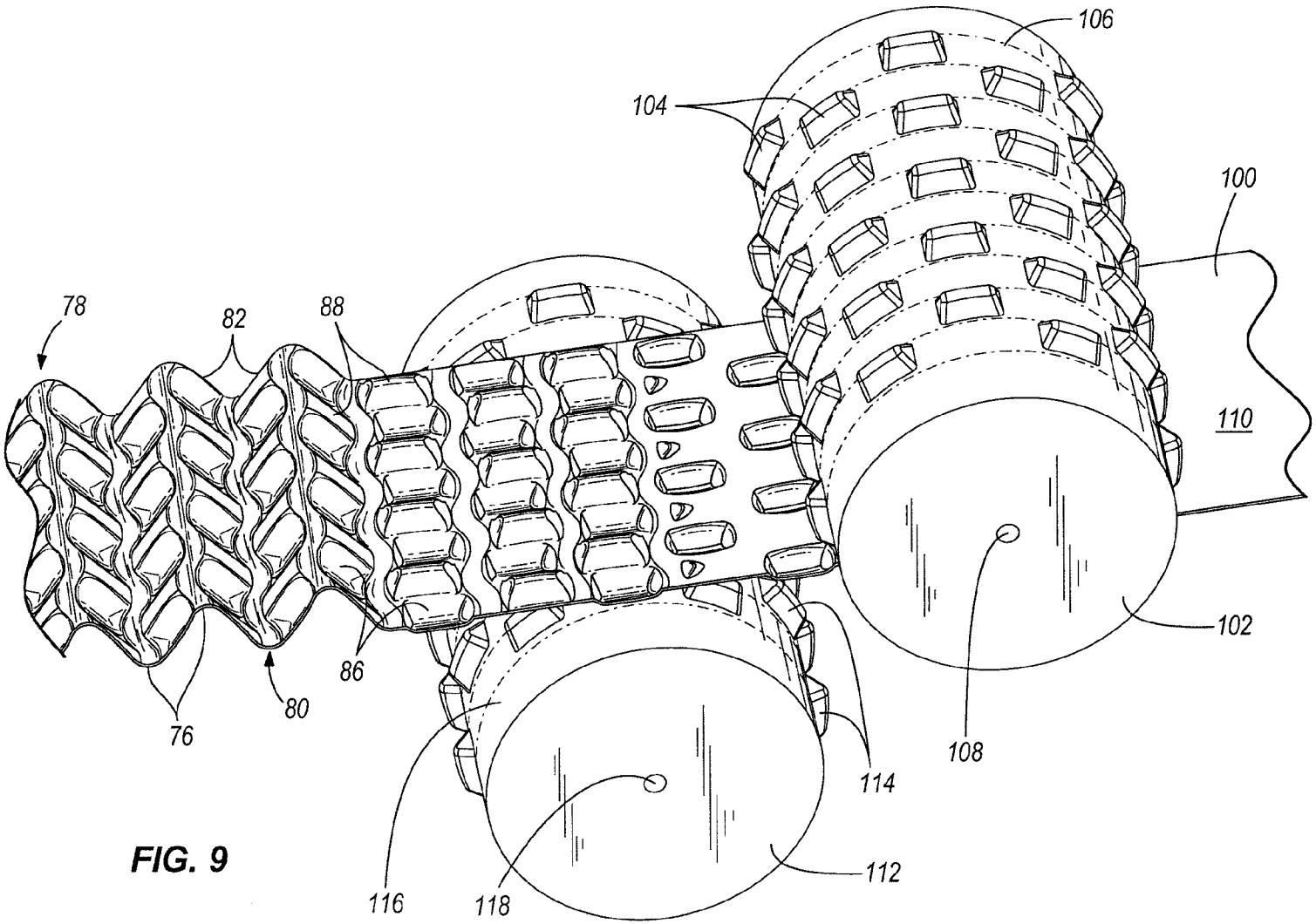
FIG. 9 illustrates a method for forming the insert shown in FIG. 5.

FIG. 9 illustrates a method of forming an insert 66 for a heat exchanger 10 according to some embodiments of the present invention. The method involves roll-forming a pattern of dimples 86 and protrusions 88 into a sheet of deformable heat conducting material 100 (e.g, aluminum, copper, bronze, and alloys including one or more of these metals). To clarify the description, the process of contour formation is shown in FIG. 9 (and discussed with reference to FIG. 9) as occurring in two distinct and consecutive steps for a particular longitudinally-located, lateral section of the sheet. First, at the right-hand side of the figure, dimples 86 are roll-formed, then, to the left of that, protrusions 88 are roll-formed. However, in practice, roll-formation of dimples 86 and protrusions 88 can be executed simultaneously (as described and illustrated with respect to the alternative embodiments shown in FIGS. 10 and 11 below). Whether the dimples 86 and protrusions 88 are formed consecutively or simultaneously, the roll-formed insert 66 in FIG. 9 then undergoes a folding process (right-hand side of the figure) to create spines 76. The steps discussed above can be incorporated into a high-speed assembly process which is described in more detail below.

As shown in FIG. 9, the method can make use of a first cylindrically-shaped roller 102 having projections 104 positioned in longitudinal rows along its curved exterior surface 106. The first roller 102 can be rotated about its axis 108 as it makes contact with a first side 110 of the sheet of deformable material 100, positioned tangentially with respect to the curved surface 106. The weight of the first roller 102 can be used to exert pressure on the deformable material such that the projections 104 form dimples 86 in the material 100. In other embodiments, the sheet of material 100 can be forced into contact with the roller 100 by other means to form dimples 86.

The shape and size of the projections 104 with respect to the thickness of the sheet of material 100 can be such that the dimples 86 formed by contact of projections 104 with the first side 110 of the sheet of deformable material 100 create their geometric complement on a second side (not visible) of the sheet 100 which is opposite to the first side 110. Thus, dimples 86 and protrusions 88 can be simultaneously formed on the first side 110 and an opposite second side of the sheet 100, respectively.

A second cylindrically-shaped roller 112 having projections 114 positioned in longitudinal rows along its curved surface 116 can be positioned adjacent to the opposite side of the sheet 100 from the first roller 102. The second roller 112 can also be rotated about its axis 118 as it makes contact with the second side of the sheet of deformable material 100, positioned tangentially with respect to the curved surface 116. In this way, dimples 86 can be formed on the second side of the sheet 100, and corresponding projections 88 can be formed on the first side 110.

Figure 8:
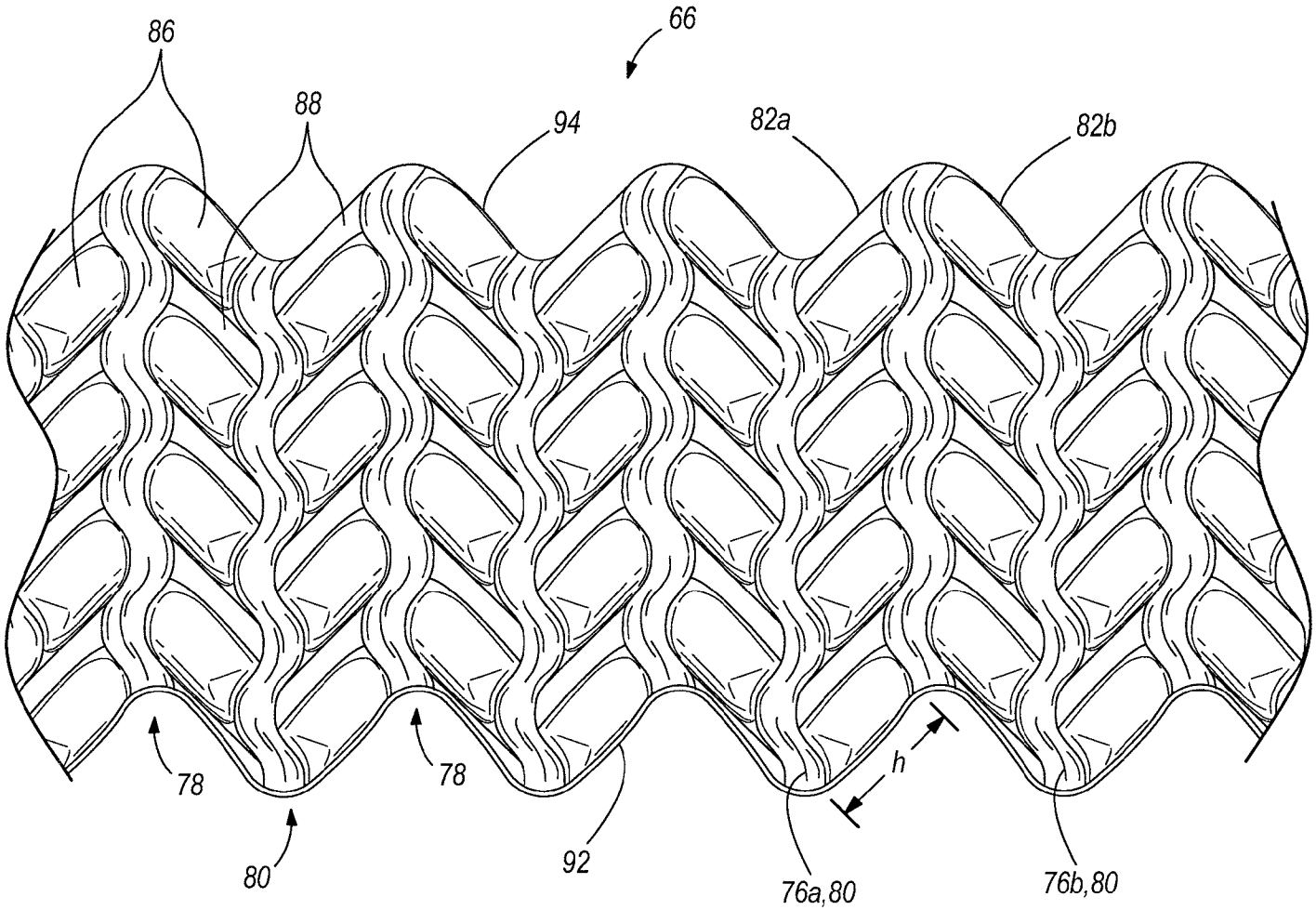
FIG. 8 is a perspective view of a partially formed insert that can be manufactured according to the method shown in FIG. 10.

The rollers 102, 112 can be formed by axially stacking cylindrical disks, the boundaries of which are illustrated by dashed lines in FIG. 9. In some embodiments, disks with various shaped projections 114 and/or circumferential spacing between projections 114 can be assembled into a roller that will form inserts 66 with different dimensions and geographies. Similarly, the disks can be circumferentially staggered to provide inserts 66 with more or less space between rows of contour elements, which can result in wider or narrower spines 76. The rollers 102, 112 can be arranged with respect to each other such that the dimples 86 and protrusions 88 on each side of the sheet are formed at specific locations with respect to each other. For example, FIGS. 7-9 illustrate how the rollers 102, 112 can be aligned to form lateral and longitudinal rows of alternating dimples 86 and protrusions 88 along the sheet 100. The lateral rows are separated by narrow gaps where the sheet 100 can be folded to form corrugations such that the lateral rows become legs 82 and the gaps become spines 76. In the illustrated embodiment, the rollers 102, 112 are staggered slightly to form serpentine-shaped spines 76. In other embodiments, the rollers 102, 112 can be aligned to form straight spines 76. In still other embodiments, the positioning, size, and/or shape of the projections 104, 114 on the first and/or second rollers 102, 112 can be varied to change the geometry and/or topography of the insert 66. In still other embodiments, curved surfaces 106, 116 of the rollers 102, 112 can be provided with indentions corresponding (i.e., in location, size, shape, etc.) to the projections 114, 104 in the opposing roller 112, 102, in order to better define the contours formed in the sheet 100.

Figure 10:
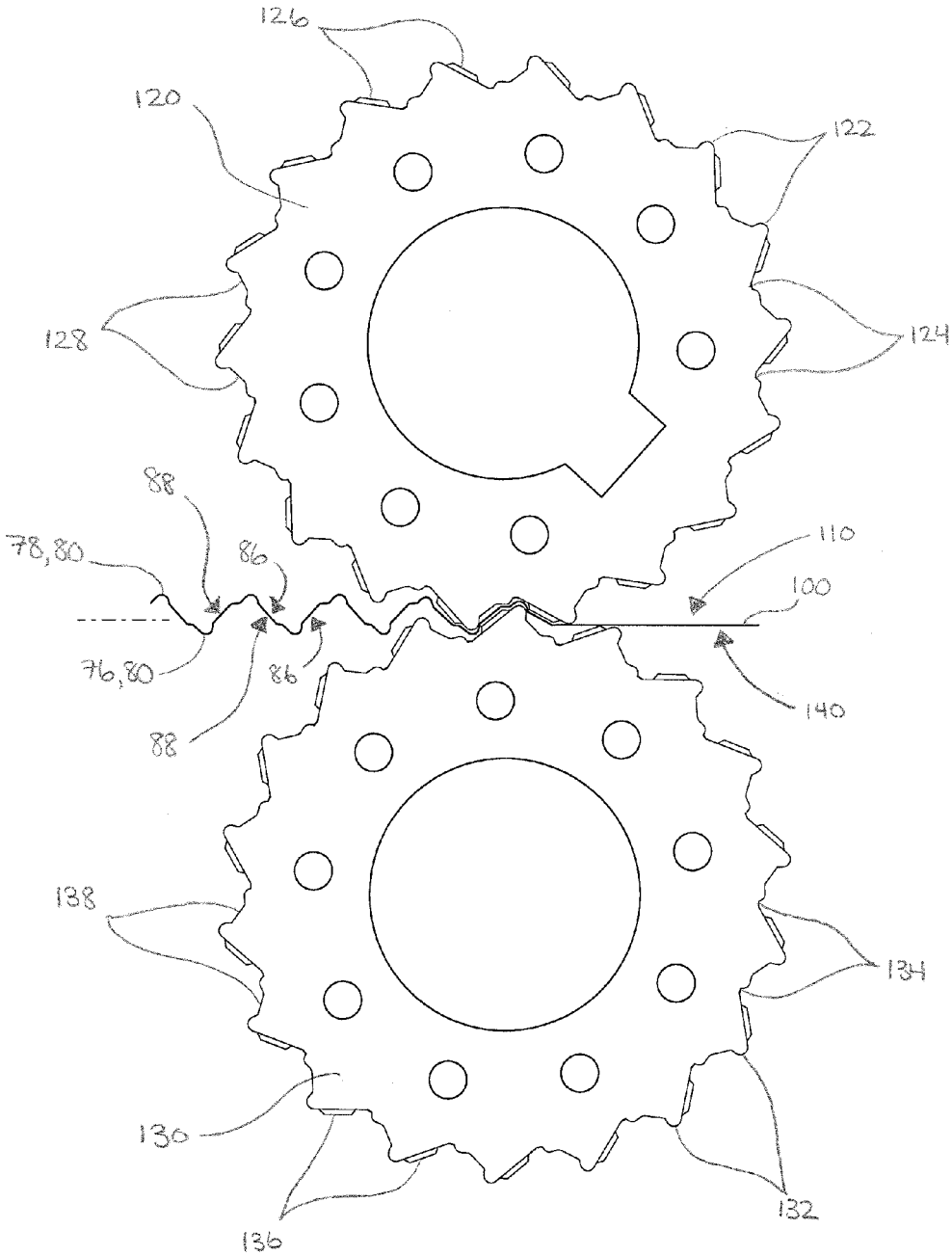
FIG. 10 illustrates another method for forming the insert shown in FIG. 5.

FIG. 10 illustrates a method of forming inserts 66 according to another embodiment of the invention. The method illustrated in FIG. 10 uses star-shaped rollers to simultaneously form contour elements and partially fold the insert 66. A first star-shaped disk 120 represents a first star-shaped roller that is positioned on a first side 110 of a sheet of deformable material 100 in the illustrated embodiment of FIG. 10. Along the circumference of the first disk 120, alternating ridges 122 and crevasses 124 create the star shape of the disk. The ridges 122 and crevasses 124 can contribute to the formation of peaks 78 and valleys 80 as will be described in further detail below. Between each ridge 122 and crevasse 124 is formed a projection 126 or an indention 128. The projections 126 and indentions 128 can form dimples 86 and protrusions 88 in the insert as will also be discussed in further detail below. In some embodiments, such as the illustrated embodiment, the projections 126 and indentions 128 can be geometric complements and have multiple planes of symmetry as discussed previously with respect to dimples 86 and protrusions 88. In other embodiments, the ridges 122 can be geometric complements of crevasses 124.

A second star-shaped disk 130 in FIG. 10 represents a second star-shaped roller that can have alternating ridges 132 and crevasses 134 that separate alternating projections 136 and indentions 138 similar (i.e., in shape, size, etc.) to those of the first disk 120. Alternatively or in addition, the projections 136 can be geometric complements of indentions 128 and projections 126 can be geometric complements of indentions 138, in which case, projections 126, 136 need not be geometric complements of indentions 128, 138 on the same disk. The second star-shaped disk 130 is positioned on a second side 140 of the sheet of material 100.

The first and second star-shaped disks 120, 130 can be positioned with respect to each other such that each ridge 122 of the first disk 120 fits within a crevasse 134 of the second disk 130 and each ridge 132 of the second disk 130 fits within a crevasse 124 of the first disk 120 as the disks 120, 130 turn on their respective axes. Thus, when the sheet of deformable material 100 is fed between the star-shaped disks 120, 130, the corresponding ridges 122 and crevasses 134 fold the material to form peaks 78, and corresponding ridges 132 and crevasses 124 fold the material to form valleys 80. Similarly, the projections 126, 136 and corresponding indentions 138, 128 form dimples 86 and protrusions 88 in the insert 66.

Figure 11:
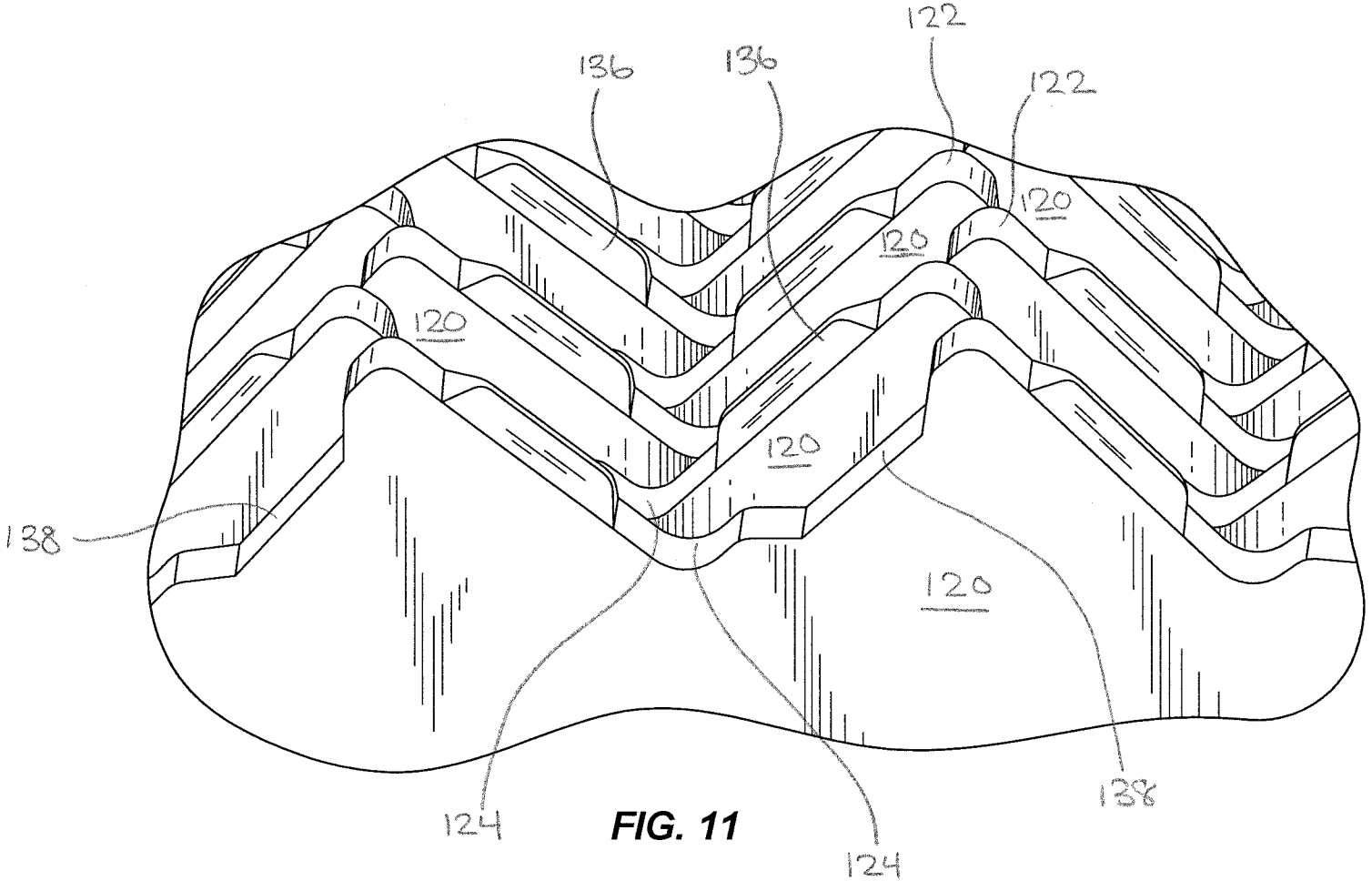
FIG. 11 is a perspective view of a section of the insert forming device shown in FIG. 10.

Star-shaped rollers can be made up of star-shaped disks 120 that are stacked axially, similar to the arrangement discussed above with respect to the embodiment of FIG. 9. FIG. 11 illustrates how these star-shaped disks 120 can be stacked in an alternating arrangement such that a projection 126 in one disk is positioned adjacent an indention 128 in a second disk. Adjacent disks can be staggered such that the ridges 122 and crevasses 124 in one disk are not in direct alignment with the ridges 122 and crevasses 124 in a second disk, as shown in FIG. 11. By complementary positioning of two star-shaped rolls having this arrangement of disks, an insert 66 can be formed having serpentine spines 76, as shown in FIGS. 3-8.

After the inserts 66 have been roll-formed and folded, they can be cut to the appropriate size and then inserted into tubes 26. In other embodiments, the inserts 66 can be cut before they are folded. Alternatively, the tubes 26 can be assembled around the inserts 66. In still other embodiments, the tubes 26 and the inserts 66 can be cut to size simultaneously.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

What is claimed is:

1. A method of manufacturing a tube including an insert for a heat exchanger, the method comprising:

feeding a sheet of heat conducting material toward a first roller and a second roller, the sheet including a length, a first side, and a second side;

roll-forming a first row of dimples in the sheet with the first roller such that the first row of dimples extends into the first side of the sheet;

roll-forming a second row of dimples in the sheet with the second roller such that the second row of dimples extends into the second side of the sheet;

folding the sheet to form a fold having a peak, a first leg and a second leg, the peak extending in a direction generally parallel to the length of the sheet and the peak being between the first row of dimples and the second row of dimples such that the first row of dimples are on the first leg and the second row of dimples are on the second leg of the fold, wherein the peak defines a serpentine-shaped spine; and after folding the sheet of material, surrounding the sheet of material with the tube having a length such that the fold extends in a direction substantially parallel to the length of the tube such that the sheet forms the insert of the tube.

2. The method of claim 1, wherein roll-forming the second row of dimples occurs after roll-forming the first row of dimples.

3. The method of claim 1, wherein folding the sheet occurs after roll-forming the first and second rows of dimples.

4. The method of claim 1, wherein folding the sheet occurs substantially simultaneously with roll-forming the first and second rows of dimples.

5. The method of claim 1, wherein folding the sheet includes folding the sheet with the first roller and the second roller.

6. The method of claim 1, further comprising contacting the first side of the sheet with projections of the first roller to form the first row of dimples; and contacting the second side of the sheet with projections of the second roller to form the second row of dimples.

7. The method of claim 6, wherein contacting the first side of the sheet with projections of the first roller occurs before contacting the second side of the sheet with projections of the second roller.

8. The method of claim 6, wherein contacting the first side of the sheet with projections of the first roller occurs substantially simultaneously with contacting the second side of the sheet with projections of the second roller.

9. The method of claim 1, wherein folding the sheet to form the fold includes folding the sheet such that at a height of the first leg between the peak and a distal end of the first leg, a width between the first and second legs is substantially constant between opposite ends of the insert spaced apart in a direction of the fold.

10. The method of claim 1, wherein roll-forming the first row of dimples includes rotating the first roller about a first axis, wherein roll-forming the second row of dimples includes rotating the second roller about a second axis substantially parallel to the first axis.

11. The method of claim 1, wherein surrounding the sheet with the tube includes inserting the sheet into the tube.

12. The method of claim 1, wherein surrounding the sheet with the tube includes assembling the tube around the sheet.

13. The method of claim 1, further comprising, after folding the sheet, cutting the sheet generally parallel to the length of the sheet to define a width of the sheet.

14. The method of claim 1, further comprising axially stacking a plurality of cylindrical disks to define at least one of the first and second rollers.

15. The method of claim 14, wherein stacking the plurality of cylindrical disks includes arranging the disks in an alternating pattern so that projections in a first one of said disks are positioned adjacent to indentations in a second one of said disks.

16. A method of manufacturing a tube including an insert for a heat exchanger, the method comprising:

feeding a sheet of heat conducting material toward a roller, the sheet including a length;

roll-forming a plurality of dimples in the sheet;

folding the sheet to form a fold that extends in a direction generally parallel to the length of the sheet and such that the plurality of dimples extend into the fold and are spaced along the fold, wherein folding the sheet includes creating a serpentine-shaped spine; and after folding the sheet, surrounding the sheet with the tube having a length such that the fold extends in a direction substantially parallel to the length of the tube such that the sheet of material forms the insert of the tube.

17. The method of claim 16, wherein folding the sheet occurs after roll-forming the plurality of dimples.

18. The method of claim 16, wherein folding the sheet occurs substantially simultaneously with roll-forming the plurality of dimples.

19. The method of claim 16, wherein folding the sheet includes folding the sheet with the roller.

20. The method of claim 16, wherein folding the sheet to form the fold includes folding the sheet such that at a height of a first leg of the fold between a peak of the fold and a distal end of the first leg, a width between the first leg and a second legs of the fold is substantially constant between opposite ends of the insert spaced apart in a direction of the fold.

21. The method of claim 16, wherein surrounding the sheet with the tube includes inserting the sheet into the tube.

22. The method of claim 16, wherein surrounding the sheet with the tube includes assembling the tube around the sheet.

23. The method of claim 16, further comprising axially stacking a plurality of cylindrical disks to define the roller.

24. The method of claim 23, wherein stacking the plurality of cylindrical disks includes arranging the disks in an alternating pattern so that projections in a first one of said disks are positioned adjacent to indentations in a second one of said disks.

* * * * *